US006811224B2

(12) United States Patent
Roney et al.

(10) Patent No.: US 6,811,224 B2
(45) Date of Patent: Nov. 2, 2004

(54) CHAIR WITH ADJUSTABLE ARMS AND/OR BACK

(75) Inventors: Lynn Roney, Franklin, TN (US); Scott Albright, Lexington, SC (US); Lance Lindenberg, Lavergne, TN (US)

(73) Assignee: First Source Furniture Group LLC, Nashville, TN (US)

( * ) Notice: Subject to any disclaimer, the term of this patent is extended or adjusted under 35 U.S.C. 154(b) by 0 days.

(21) Appl. No.: 10/461,975

(22) Filed: Jun. 13, 2003

(65) Prior Publication Data

US 2004/0070251 A1 Apr. 15, 2004

Related U.S. Application Data

(63) Continuation-in-part of application No. 10/267,422, filed on Oct. 9, 2002, now Pat. No. 6,705,678.
(60) Provisional application No. 60/417,441, filed on Oct. 10, 2002.

(51) Int. Cl.[7] ..... A47C 7/54
(52) U.S. Cl. ..... 297/411.35; 297/411.36; 297/411.38
(58) Field of Search ..... 297/411.35, 411.36, 297/411.37, 411.38

(56) References Cited

U.S. PATENT DOCUMENTS

| | | | |
|---|---|---|---|
| 518,097 | A | 4/1894 | Derby |
| 735,313 | A | 8/1903 | Stubbs |
| 2,030,635 | A | 2/1936 | Horwitt et al. |
| 2,091,733 | A | 8/1937 | Hemminger et al. |
| 2,599,301 | A | 6/1952 | Van Buren |
| 2,637,371 | A | 5/1953 | Boutin |
| 2,942,651 | A | 6/1960 | Binding |
| 2,988,398 | A | 6/1961 | Hamilton |
| 3,291,527 | A | 12/1966 | Hall et al. |
| 3,950,027 | A | 4/1976 | Wilson |
| 5,374,102 | A | 12/1994 | Archambault et al. |
| 5,484,187 | A | 1/1996 | Doerner et al. |
| 5,599,067 | A | 2/1997 | Schuelke et al. |
| 5,647,638 | A | 7/1997 | Ritt et al. |
| 5,664,835 | A | 9/1997 | Desanta |
| 5,667,274 | A | 9/1997 | Blackman |
| 5,667,277 | A | 9/1997 | Van De Riet |
| 5,884,976 | A | 3/1999 | Breen et al. |
| 5,904,398 | A | 5/1999 | Farricielli |
| 6,086,156 | A | 7/2000 | Breen et al. |
| 6,158,810 | A | 12/2000 | Galloway |
| 6,352,307 | B1 | 3/2002 | Engman |

FOREIGN PATENT DOCUMENTS

| | | |
|---|---|---|
| EP | 0 049 700 A2 | 4/1982 |
| GB | 2 041 439 A | 9/1980 |

*Primary Examiner*—Peter R. Brown
(74) *Attorney, Agent, or Firm*—Flynn, Thiel, Boutell & Tanis, P.C.

(57) ABSTRACT

A chair with a back arrangement employing a back shell slidably supported on a pair of uprights projecting upwardly from opposite sides of the chair seat. The chair includes manually releasable latching mechanisms which cooperate with the uprights to allow height adjustment of the back arrangement. The chair additionally incorporates an adjustment mechanism which allows manual adjustment of the chair arms into the desired position.

24 Claims, 15 Drawing Sheets

CHAIR WITH ADJUSTABLE ARMS AND/OR BACK

CROSS-REFERENCE TO RELATED APPLICATIONS

This application is a continuation-in-part of copending application Ser. No. 10/267 422 filed Oct. 9, 2002 now U.S. Pat. No. 6,705,678, the entire disclosure of which is incorporated herein by reference.

This application claims priority under 35 U.S.C. §119(e) of copending provisional application Ser. No. 60/417 441 filed Oct. 10, 2002, the entire disclosure of which is incorporated herein by reference.

FIELD OF THE INVENTION

This invention relates to a chair as typically used in offices and the like and, more specifically, to a chair having an improved back arrangement employing a back shell slidably supported on a pair of uprights projecting upwardly from adjacent opposite sides of the chair seat, and which employs manually-releasable latching mechanisms cooperating with each of the uprights to permit height adjustment of the back arrangement.

This invention also relates to a chair of the type typically used in offices and the like which, more specifically, incorporates an improved adjustment mechanism cooperating with the chair arms for permitting manual adjustment of the arms into one of several different selectable positions.

BACKGROUND OF THE INVENTION

Chairs, and particularly office-type chairs, are conventionally provided with a height-adjustable back arrangement. Such arrangements are typically constructed from a significant number of different parts so that the resulting construction is complex and expensive to manufacture, and oftentimes bulky, so that the aesthetics of the back are impaired. Such back arrangements also frequently employ a height-adjusting mechanism positioned at least partially internally of the back arrangement, generally centrally thereof, and such mechanism further increases the structural complexity and spatial requirements of the back arrangement. The back height-adjusting mechanism is, in many instances, also disposed so that manual release thereof involves an actuator which is accessible solely from the back side of the chair, and as such the release actuator not only impairs the aesthetics of the chair back, but also is inconvenient to utilize since back height-adjustment can not be effected while the occupant remains seated in the chair.

Chairs, particularly those used in office or similar working environments, are also typically provided with arms disposed adjacent opposite sides of the seat, and such arms are frequently supported by appropriate adjustment mechanisms which permit the height and/or horizontal position of the arm to be selectively varied. While numerous mechanisms have been developed for permitting vertical or horizontal positional adjustment of chair arms, most of these mechanisms involve a large number of parts which result in undesired structural complexity and spatial requirements, and as such impair the desired aesthetics of the arm arrangement.

More specifically, chair arms associated with chairs of the type used in offices and the like frequently employ a motion adjustment mechanism which enables the height of the chair arm to be adjusted. In recent years it has also been a more standard practice to mount the arm rest for horizontal lateral movement, typically horizontal pivoting movement, to enable the chair arm to be oriented in different use positions. Such use positions typically include a normal center position as well as positions where the arm rest angles either outwardly or inwardly relative to the center position. These mechanisms have frequently employed spring-urged detents for holding the chair arm in the selected position, but such mechanisms have also permitted inadvertent pivoting of the arm rest when such movement is not desired inasmuch as the force required to release the detent is necessarily of small magnitude.

To overcome the undesired accidental movement associated with detent type mechanisms, other chair arms have utilized what is known as a "lift-and-lock" mechanism wherein the chair arm must first be lifted to disengage a latch such as a tooth and slot arrangement, following which the chair arm can be horizontally pivoted and then lowered so as to be latched into a different position. While this latter type of mechanism does provide a positive locking of the chair arm in the selected position, nevertheless in some situations the requirement that the arm rest be entirely lifted upwardly results in a structure which is difficult to manipulate.

Accordingly, it is an object of this invention to provide an improved chair having a simplified height-adjustable back arrangement associated therewith. The back arrangement, in a preferred embodiment, is defined principally by a back shell provided with support parts, such as sleeves, adjacent opposite sides thereof. The support sleeves are slidably supported on respective uprights which are joined to and project upwardly adjacent opposite sides of the chair seat. A manually-releasable latching mechanism cooperates between each support sleeve and its respective upright whereby a seated occupant, by using right and left hands, can simultaneously release both latching mechanisms and effect vertical slidable displacement of the back shell to adjust the position thereof.

In the improved chair of this invention, as aforesaid, the uprights preferably function to support chair arms thereon adjacent upper ends thereof. The uprights are preferably positioned adjacent but spaced slightly forwardly from rear corners of the chair seat so as to provide desired overall chair aesthetics, and to improve occupant access to the releasable latching mechanisms.

In the improved chair of the present invention, as aforesaid, the chair arms are preferably supported within the uprights by releasable height-adjusting mechanisms which can be easily manually released by the seated occupant, and which permit the height of the individual chair arms to be vertically adjusted relative to the upright. The releasable height-adjusting mechanisms which control the height of the chair arms are confined within the uprights so as to be surrounded not only by the upright but also by the support sleeve associated with the chair shell, thereby providing a construction which is compact, space saving and aesthetically desirable.

It is also an object of the invention to provide a chair, such as an office type chair, having an improved adjustment mechanism associated with and cooperating between the chair arm and the support therefore so as to permit the position of the chair arm to be readily manually adjusted. The mechanism preferably incorporates a simplified height-adjusting mechanism which is confined within the support upright for the chair arm, which mechanism involves minimal structural parts and operational complexity so as to provide a simple and compact operating arrangement. The mechanism preferably includes a release button which can be easily manually released and is positioned directly under the chair arm for ease of operation. The release button couples to an elongate trigger rod which projects vertically interiorly of the upright and, at its lower end, has an integral cam part which cooperates with and effects sideward movement of a latch plunger which is normally spring-urged into latching engagement with one of a series of latching shoulders or steps defined vertically along one side of the upright.

It is a further object of this invention to provide an improved adjustment mechanism which provides a lift-and-lock function, but which does not require vertical lifting of the entire arm rest. Rather, in the present invention, the mechanism which allows lateral horizontal pivoting of the arm rest does so utilizing a universal-type connection between the arm rest and its support post so that the arm rest can be vertically pivoted upwardly a limited extent so as to disengage the lock, following which the arm rest can be horizontally laterally pivoted into the desired position, following which the arm rest is vertically swung downwardly to reengage the lock. The lift-and-lock function permits angular displacement to occur without affecting or disturbing the height-adjusting mechanism which is coupled therebelow and is disposed within the supportive upright.

Other objects and purposes of the invention, including structural and operational advantages thereof, will be apparent to persons familiar with constructions of this general type upon reading the following specification and inspecting the accompanying drawings.

Figure 1:
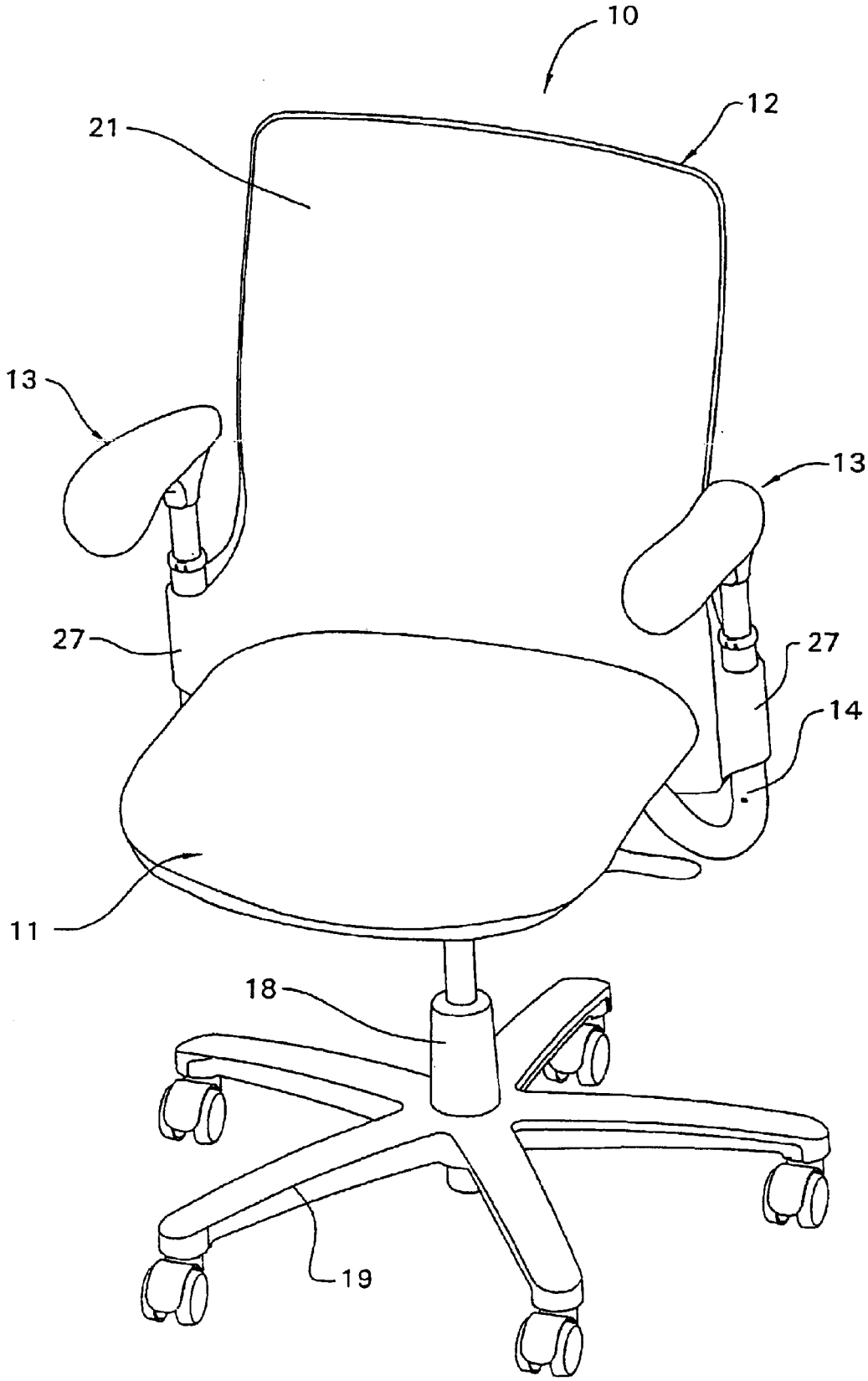
FIG. 1 is a front perspective view of a chair embodying therein the present invention.
Figure 2:
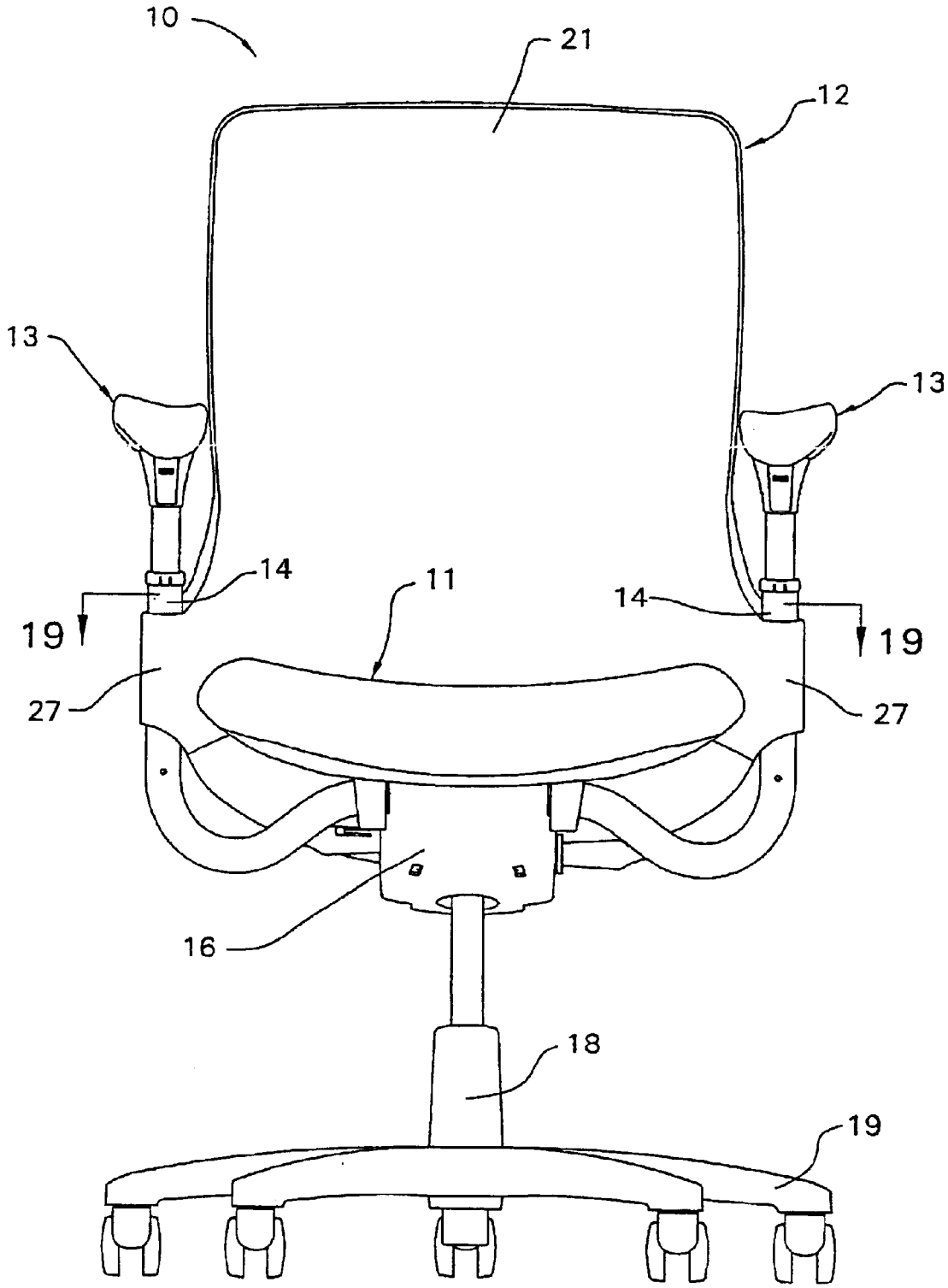
FIG. 2 is a front elevational view of the chair shown in FIG. 1.
Figure 3:
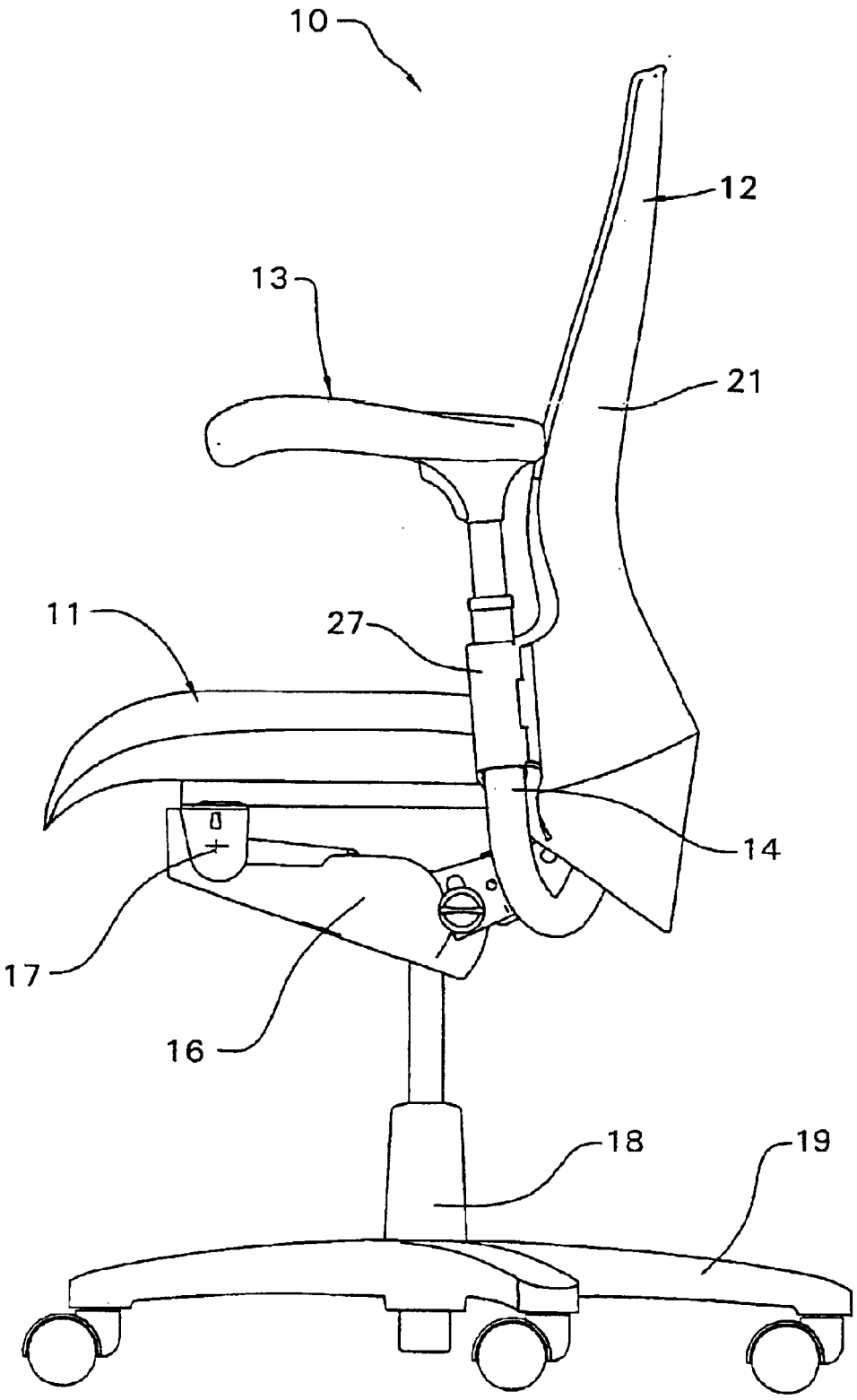
FIG. 3 is a side elevational view of the chair shown in FIG. 1.
Figure 4:
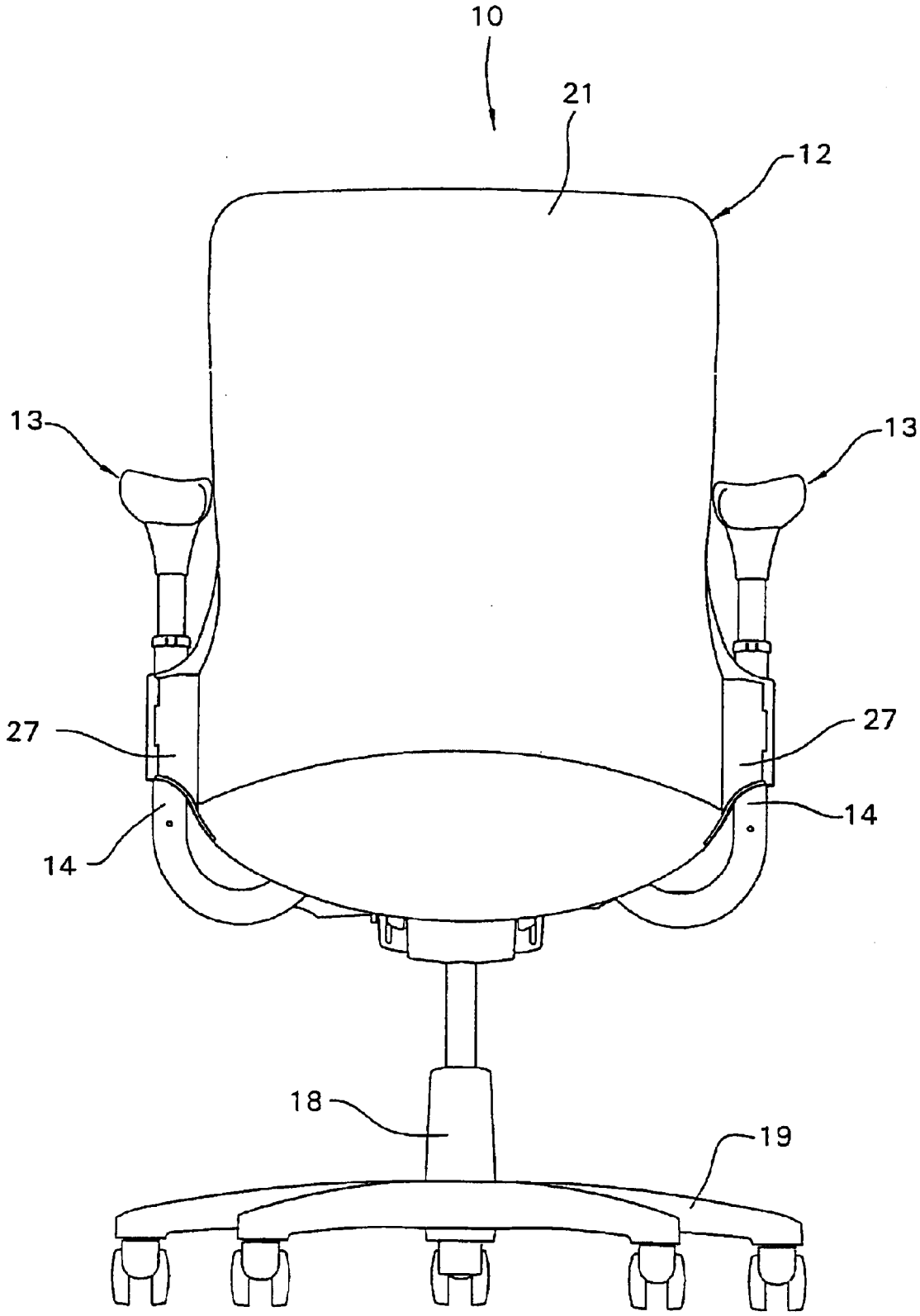
FIG. 4 is a rear elevational view of the chair shown in FIG. 1.

Certain terminology will be used in the following description for convenience and reference only, and will not be limiting. For example, the words "upwardly", "downwardly", "rightwardly", "leftwardly" will refer to directions as appearing in the drawings, and will also refer to the same directions with respect to an occupant seated in the chair. The words "inwardly", "outwardly" will refer to the geometric center of the chair and designated parts thereof. Said terminology will include the words specifically mentioned, derivatives thereof, and words of similar import.

DETAILED DESCRIPTION

Referring to FIGS. 1–4, there is illustrated a chair 10 according to the present invention, which chair is of the type conventionally used in offices and the like. The chair 10 includes a seat 11 which projects forwardly from an upwardly projecting back 12. A pair of arm rest assemblies 13 are movably supported on uprights 14 which project upwardly from adjacent opposite sides of the seat 11. A conventional chair control arrangement 16, which defines a generally horizontal tilt axis 17, connects the seat 11 to the upper end of an upright pedestal 18, the latter typically having a height-adjusting air spring associated therewith. The pedestal 18 at its lower end couples to a conventional base 19, the latter typically having a plurality of radially outwardly projecting legs provided with casters adjacent the outer ends thereof.

Figure 5:
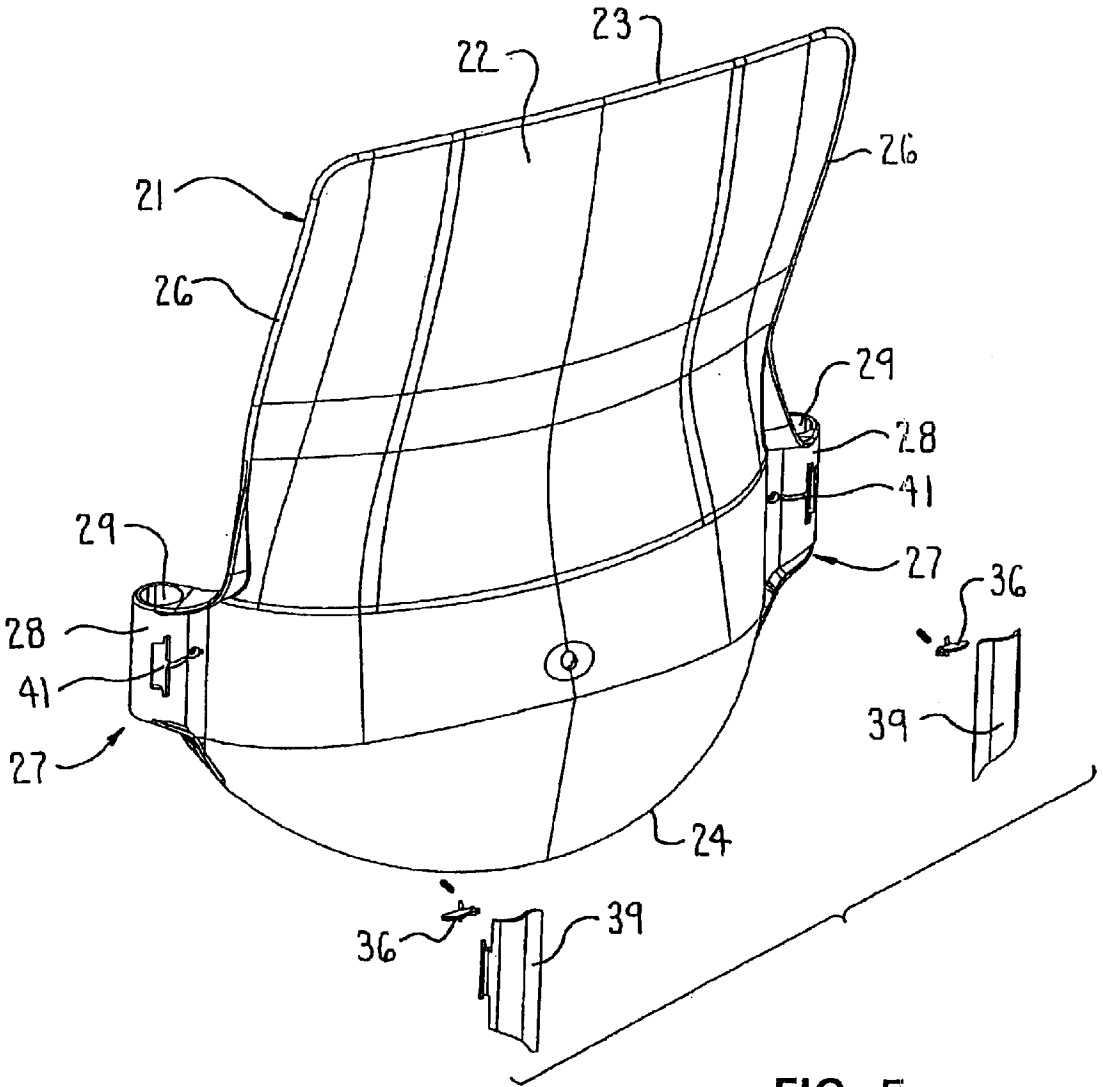
FIG. 5 is a rear perspective view of the back shell of the chair, with the height-adjusting mechanisms associated therewith shown in exploded view.
Figure 6:
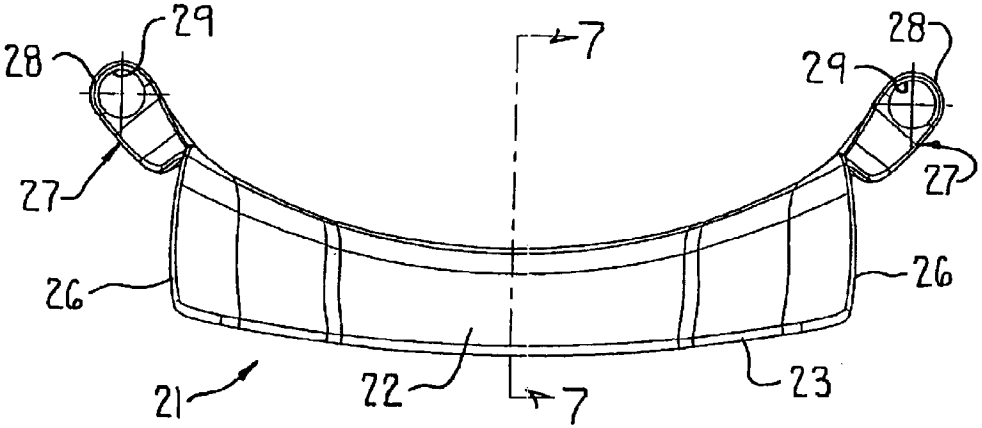
FIG. 6 is a top view of the back shell shown in FIG. 5.
Figure 7:
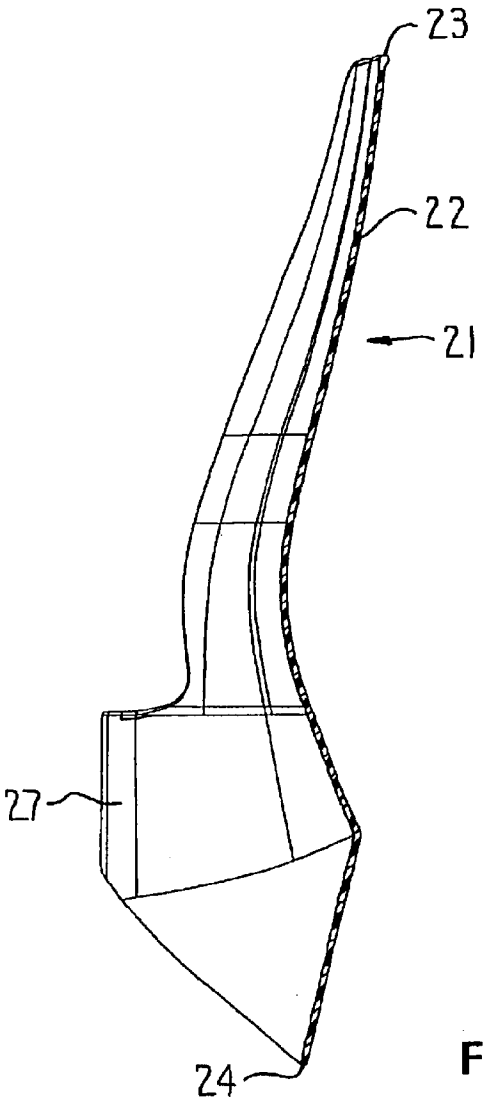
FIG. 7 is a sectional view taken generally along line 7—7 in FIG. 6.

The back 12 is defined principally by a monolithic one-piece back member or shell 21 which is typically formed of a synthetic resin material such as a plastics material. This one-piece back member 21, as illustrated in FIGS. 5–7, includes a main upright panel 22 which defines the dominant horizontal and vertical extent of the chair back for supportive engagement with the back of a seated occupant. The main panel 22 extends vertically between respective upper and lower edges 23 and 24, and extends horizontally between opposite side edges 26.

The back member 21 also includes mounting parts 27 which are monolithically and integrally fixed to and project outwardly from opposite sides of the main panel 22 in the vicinity of the lower end thereof for permitting coupling of the back member 21 to the arm uprights 14. The mounting parts 27 project outwardly and forwardly relative to the respective adjacent side edge of the main panel 22, and each includes a generally vertically elongate support sleeve 28 having a generally vertical and cylindrical opening 29 extending therethrough for accommodating the respective arm upright 14 as described below.

Figure 14:
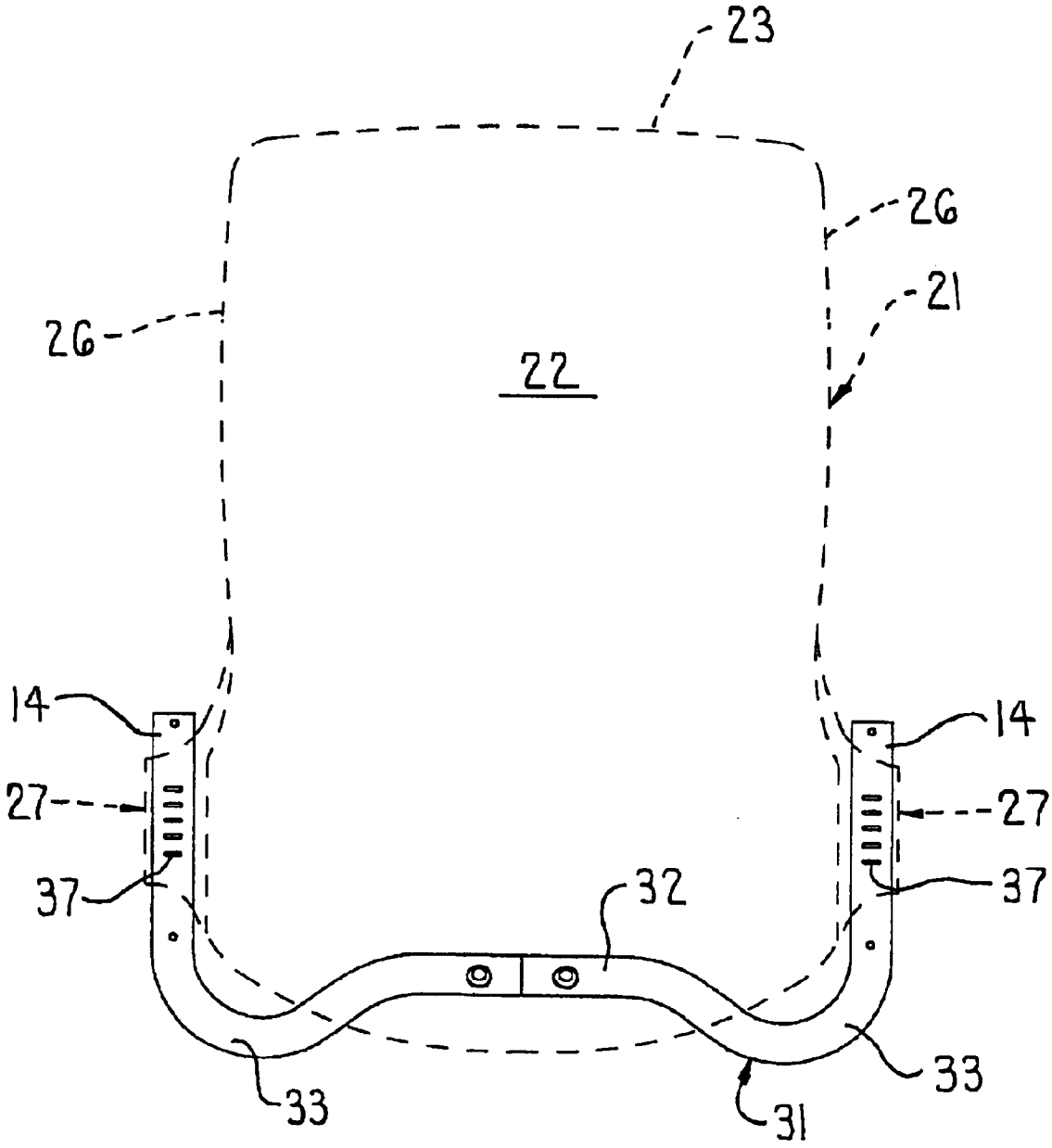
FIG. 14 shows the U-shaped arm member of the chair and its association with the back shell.

The arm uprights 14 are cantilevered upwardly in generally parallel relation from adjacent opposite sides of the chair seat 11 generally in the vicinity of the rear corners thereof. The arm uprights 14 are part of a generally U-shaped arm member 31 (FIG. 14) which has a center part 32 thereof disposed under the chair seat and rigidly joined relative thereto, such as by being secured to a part of the housing associated with the chair control. The center part 32 joins through bends 33 to the uprights 14. The U-shaped chair member 31 may be formed from a one-piece tubular element, or may be formed from two L-shaped tubular pieces which are mirror images of one another and joined to the chair seat so as to provide a generally U-shaped arrangement.

The back member 21 is vertically slidably supported on the arm uprights 14, and a manually-releasable latching mechanism 34 (FIGS. 15–16) cooperates between each mounting part 27 and its respective arm upright 14 for controlling the vertical position of the back member.

The latching mechanism 34 includes a pivoting latching lever 36 which is adapted for latching engagement within one of a plurality of slots 37 which are formed in and extend transversely relative to the exterior surface of the arm upright 14. The latching lever 36 is acted on by spring 38 which biases the latching lever into its latching position. An activating member or paddle 39 is hingedly mounted on the support sleeve 28 of the chair shell and cooperates with the latching lever 36 for permitting the latter to be moved into a released or unlatched position.

Figure 9:
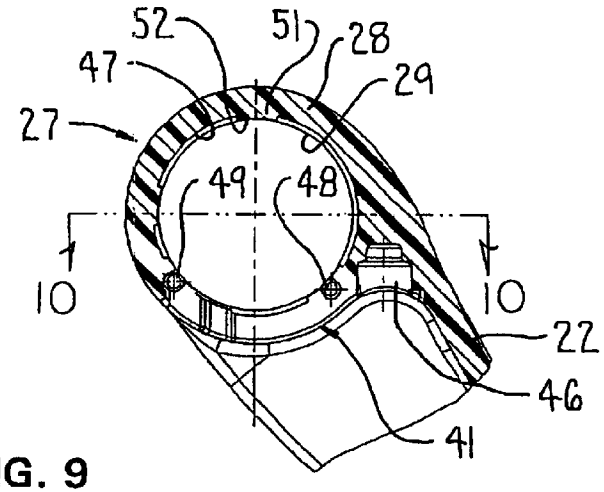
FIG. 9 is a fragmentary sectional view taken generally along line 9—9 in FIG. 8.
Figure 10:
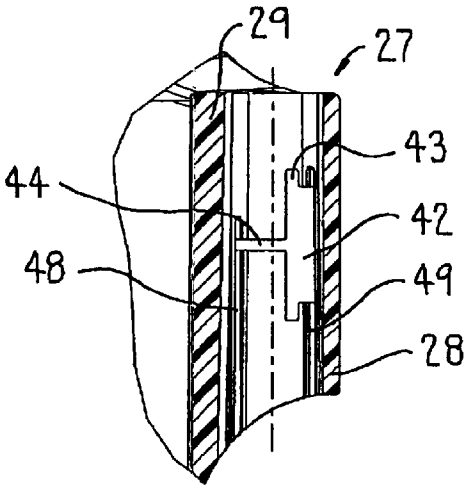
FIG. 10 is a fragmentary sectional view taken generally along line 10—10 in FIG. 9.
Figure 8:
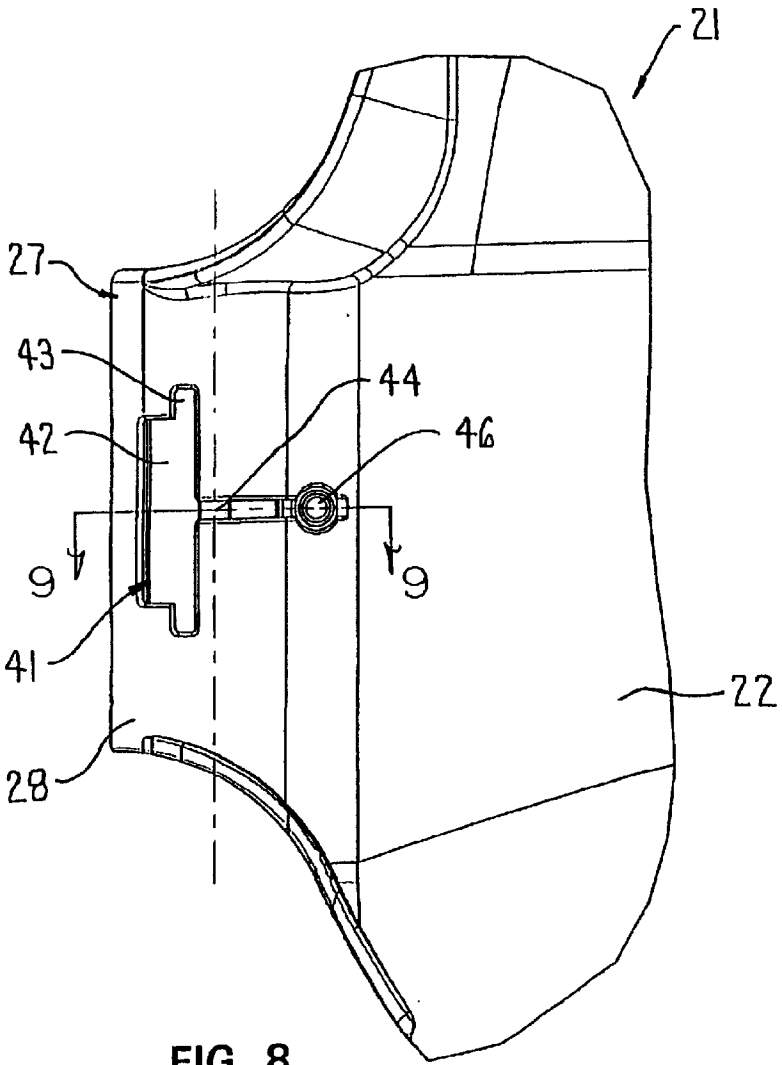
FIG. 8 is an enlarged, fragmentary back view showing the mounting part associated with one side of the back shell.

To accommodate the latching mechanism 34, and referring specifically to FIGS. 8–10, the support sleeve 28 associated with the back member 21 has a generally T-shaped opening 41 which extends transversely through the back side of the support sleeve for communication with the cylindrical opening 29 defined interiorly thereof. The T-shaped opening 41 is oriented generally horizontally and includes a generally rectangularly-shaped main opening 42 which, along a vertical edge thereof closest to the main panel of the chair back, is provided with slot-like parts 43 which are elongated upwardly and downwardly from the respective upper and lower edges of the main opening 42. The T-shaped opening 41 also includes a horizontally elongate narrow slot 44 which projects transversely away from the vertical edge of the main opening 42 which has the slot-like parts 43 associated therewith. The elongate narrow slot 44, at the end thereof remote from the main opening 42, communicates with a blind bore 46 which opens inwardly from the exterior rear surface where the support sleeve 28 merges into the main panel of the back member substantially as illustrated in FIG. 9.

The support sleeve 28 of the back shell has a first vertically elongate slot-like groove 48 formed inwardly from the inner sleeve wall 47, which groove 48 communicates with the narrow slot 44 adjacent the remote end thereof, that is, in the vicinity of the blind bore 46. This groove 48 extends vertically on both sides of the narrow slot 44, and accommodates therein a hinge pin associated with the latching lever 36 as discussed hereinafter.

The support sleeve 28 also has a further slot-like groove 49 which opens inwardly from the inner sleeve surface 47 and extends vertically therealong. This groove 49 extends vertically generally along the edge of the main opening 42 which is on the side thereof remote from the narrow slot 44. Groove 49 also projects vertically both above and below the respective upper and lower edges of the main slot 42 so as to accommodate therein a hinge pin associated with the activating paddle 39, as discussed hereinafter.

The inner surface 47 of the support sleeve 28 also has a plurality of ribs 51 extending vertically therealong in angularly spaced relationship therearound. Each of these ribs defines thereon a inner contact surface 52 which is of a partial cylindrical configuration whereby the plurality of contact surfaces 52 provides a snug but slidable supportive engagement with the arm upright 14.

Figure 18:
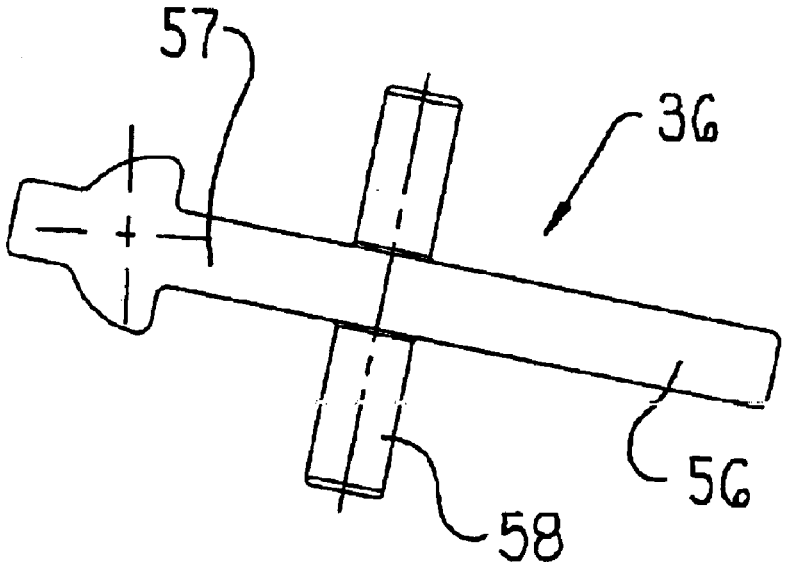
FIG. 18 is a side view of the latching lever shown in FIG. 17.
Figure 17:
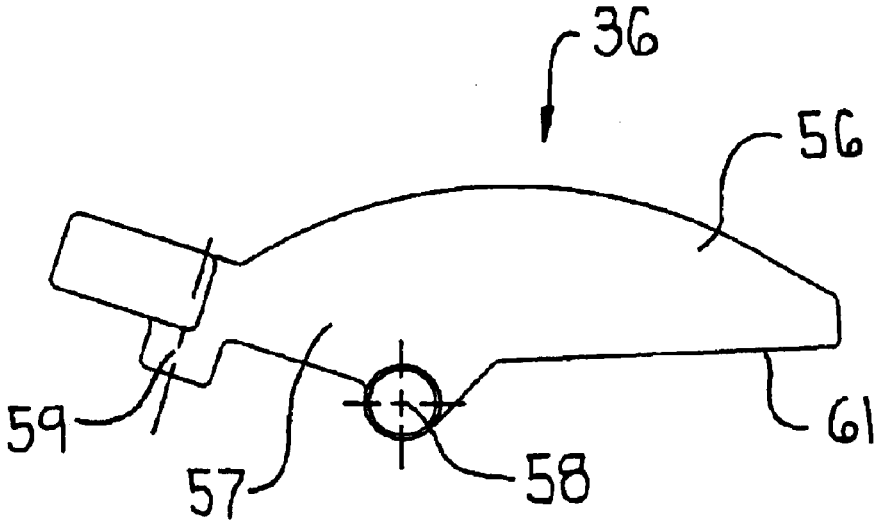
FIG. 17 is a top view showing the latching lever associated with the back shell height adjustment mechanism.
Figure 19:
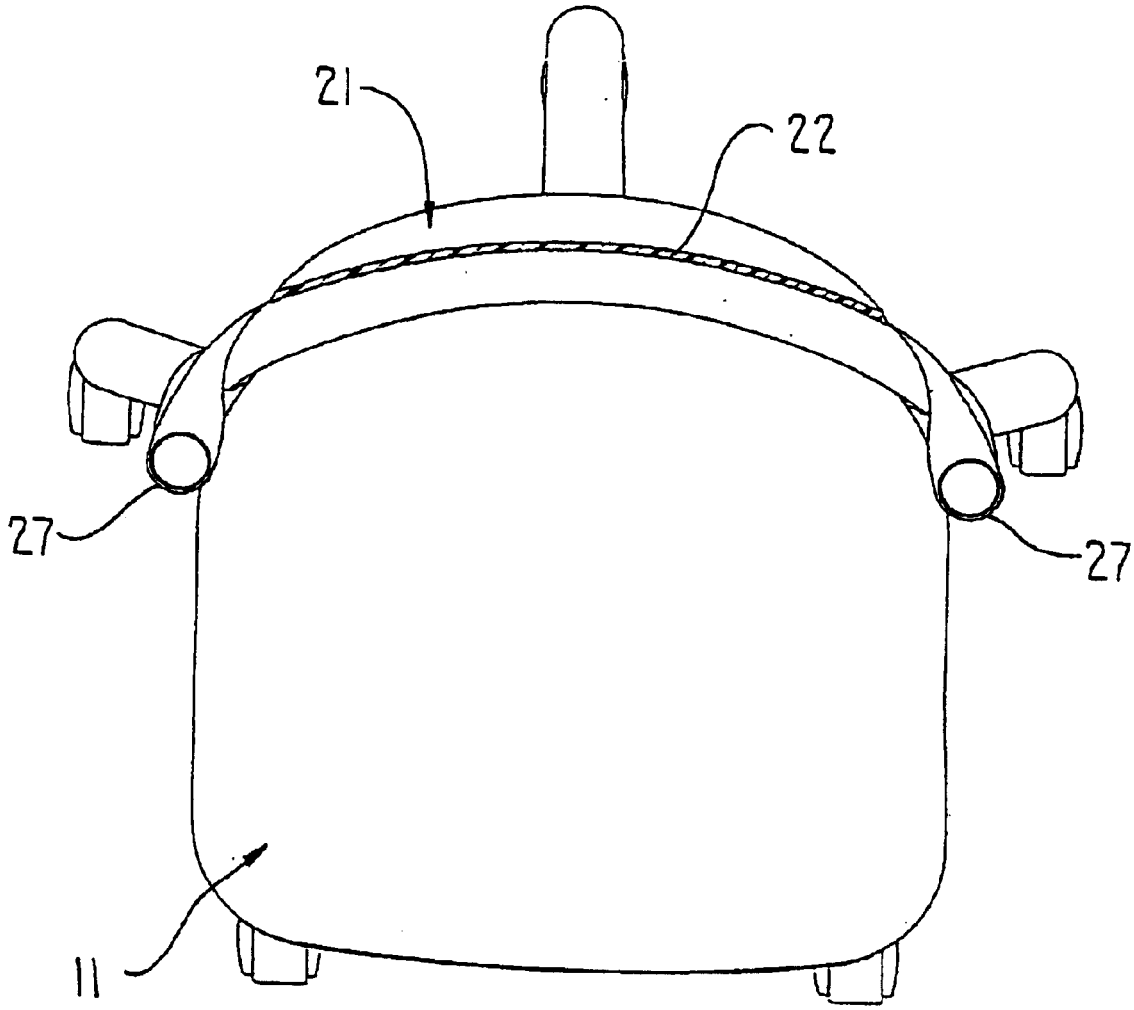
FIG. 19 is a diagrammatic plan view taken generally along line 19—19 in FIG. 2.

Considering now the construction and function of the latching mechanism 34 in greater detail, the latching lever 36 as illustrated in FIGS. 17–18 includes first and second lever parts 56 and 57, respectively, which project generally outwardly in opposite directions from a center hub or pivot pin 58, the latter projecting transversely outwardly from opposite sides of the lever member. The lever member also has a nub or pin 59 projecting outwardly from one side of the lever part 57 at a location disposed more closely adjacent the outer free end thereof. The first lever part 56 also defines a flat edge 61 extending outwardly along one side thereof.

The lever member 36 is positionally and pivotally supported on the support sleeve 28 of the chair back by initially inserting the first lever part 56 into the interior of the support sleeve 28, such being accomplished by inserting the lever part 56 and the center pivot 58 through main opening 42. When so disposed the pivot pin 58 of the lever is snapped into the slot-like groove 48, with the lever parts being positioned within and projecting out through the narrow elongate slot 44. The second lever part 57 projects outwardly through the slot 44 so that the outer end of the second lever part 57, and specifically the nub 59 thereon, is aligned generally with the blind bore 46. The spring 38 has one end thereof seated in the blind bore, and the other end fitted over the projection or nub 59, whereby the spring 38 urges the latching lever to pivot about the pivot pin 58 so that the flat surface 61 on the first lever part 56 is always urged radially inwardly toward a position of latching engagement with the arm upright 14. In this regard, the arm upright as noted above has a plurality of vertically spaced slots 37 extending transversely across the outer surface thereof, which slots 37 each have a flat bottom wall 62 adapted for engagement with the flat edge 61 on the first lever part 56 when the latter is in a latched position wherein it is engaged within one of the slots.

Figure 13:
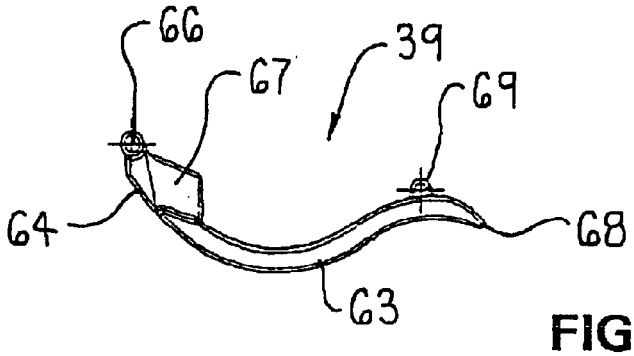
FIG. 13 is a top view of the actuating paddle shown in FIG. 11.
Figure 11:
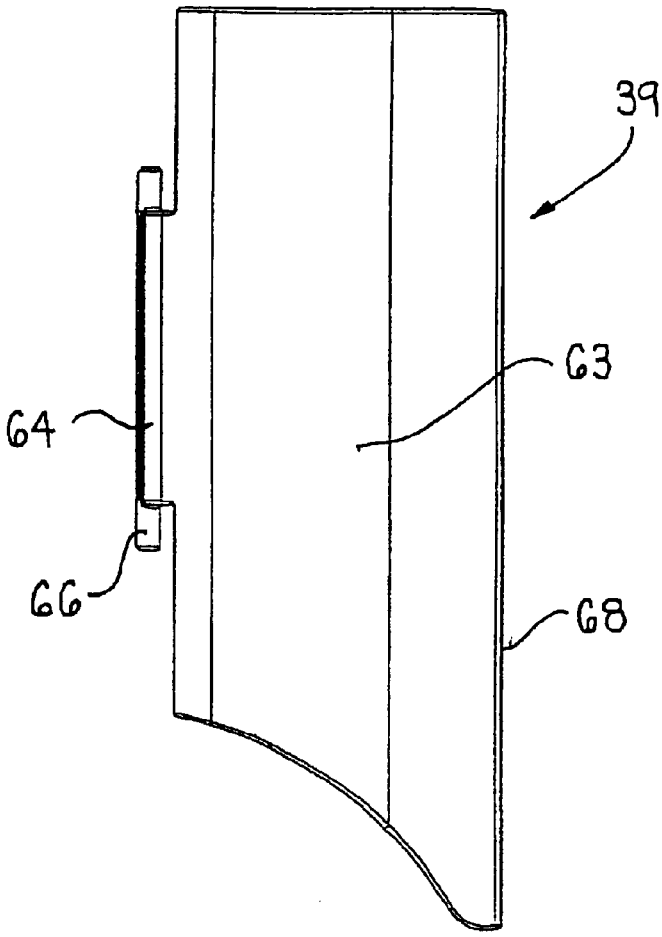
FIG. 11 is a rear elevational view showing the actuating paddle which mounts to the mounting part of the back shell.
Figure 12:
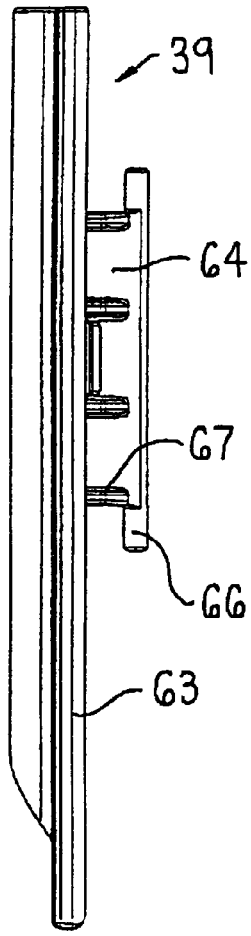
FIG. 12 is a side elevational view of the actuating paddle shown in FIG. 11.

The latching mechanism also includes the activating member or paddle 39, the latter also effectively functioning as a shroud for enclosing the latching mechanism. This activating paddle 39 as illustrated in FIGS. 11–13 includes a main panel part 63 which, in cross section, has a generally arcuate configuration similar to the outer configuration of the support sleeve 28. The panel part 63 of the paddle 39 has a flange 64 associated with one upright edge thereof, the latter in turn being joined to a vertically elongate hinge pin 66 which is offset inwardly from the panel 63 and flange 64. The hinge pin 66 is of sufficient vertical extent that upper and lower edge portions thereof project respectively vertically above and below the extremities of the flange 64 as illustrated in FIGS. 11–12. A plurality of reinforcing ribs 67 couple the pin 66 and flange 64 to the main panel part 63. The main panel part 63 of the paddle 38 has, adjacent the opposite longitudinally extending vertical edge 68 thereof, a small pin or nub 69 protruding inwardly therefrom at a location which is approximately horizontally aligned with the center of the flange 64.

The activating paddle 39 is mounted to the support sleeve 28 by initially positioning the paddle adjacent the T-shaped opening 41 so that the hinge pin 66 on the paddle is aligned with the slot-like parts 43 associated with one edge of the main opening 42. The paddle is then moved inwardly so that the hinge pin 66 passes through the slot-like openings 43, with the hinge pin then being moved transversely across the main opening 42 so as to be aligned with and snapped into the slot-like groove 49 disposed adjacent the other edge of the main opening 42. When so positioned, the main panel part 63 of the paddle 39 effectively overlies the entirety of the T-shaped opening 41, and the free edge 68 of the paddle is disposed such that the protrusion 69 is positioned to abuttingly contact a back surface 71 provided on the free end of the second lever part 57 substantially as illustrated in FIGS. 15–16.

Figure 15:
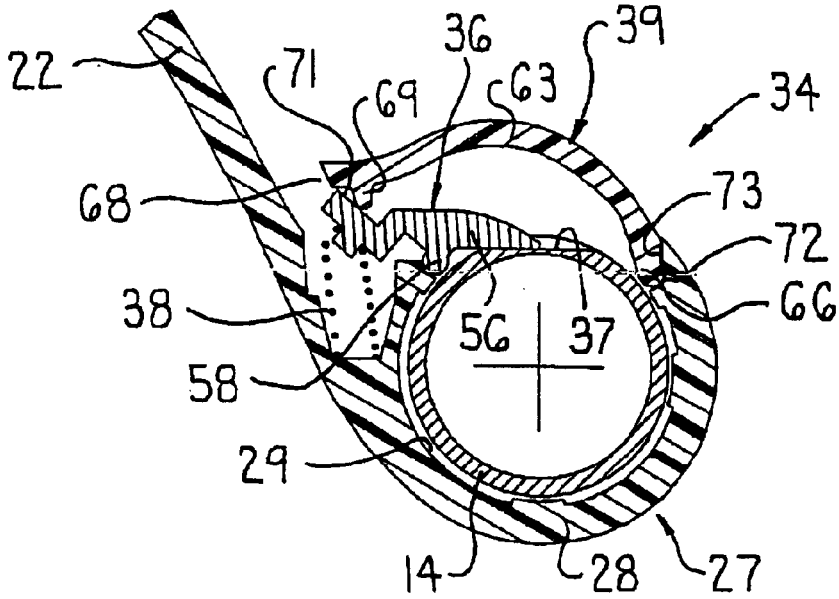
FIG. 15 is an enlarged, fragmentary cross sectional view taken through the arm mounting part of the back shell and showing the height-adjusting mechanism in its latched position.

The spring 38 acting against the latching lever swings the latter outwardly (clockwise in FIG. 15) which in turn acts against the free end of the paddle 39 to swing the latter outwardly into the latched position as illustrated by FIG. 15. In this latched position, the outward swinging of the paddle 39 is restricted by the opposed stop surfaces 72 on the paddle and 73 on the support sleeve contacting one another. In this latched position, however, the spring 38 exerts little, if any, biasing force.

Figure 16:
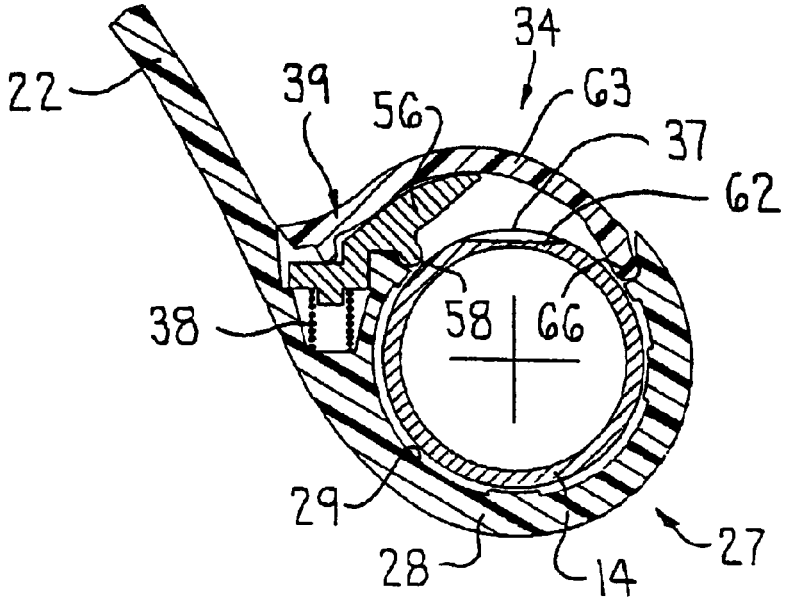
FIG. 16 is a view corresponding to FIG. 15 but showing the height-adjusting mechanism in an unlatched position.

When the latch is to be released, however, the paddle 39 is manually depressed toward the support sleeve 28 and pivoted inwardly (counter-clockwise in FIG. 15) into the position illustrated in FIG. 16. In this position, the free end of the paddle 39 acts against the end of lever part 57 causing the latter to be moved inwardly to effect compression of the spring 38, and simultaneously causing the latching lever part 56 to be swung outwardly so as to disengage the latching slot 37.

With the arrangement of the present invention, the height of the back member 21 can be adjusted relative to the chair seat 11 while the user of the chair is seated. To effect such height adjustment, the seated occupant reaches down and somewhat rearwardly so as to engage right and left hands with the respective right and left mounting parts of the chair back. The hands are positioned so that the fingers project outwardly around the support sleeves for engagement with the respective activating paddles 39. The fingers on both hands are then simultaneously pressed against the activating paddles 39 so that the paddles swing inwardly into the unlatching position illustrated in FIG. 16. During this inward swinging of the activating paddles, the free end of the activating paddle acts against the lever part 57 of the latching lever and swings it inwardly about pivot 58 causing compression of the spring 38. This causes the first lever part 56 to swing outwardly so as to disengage the slot 37 on the arm upright 14. With both latches disengaged, and with the occupant's hands continuing to grip the support sleeves 28, the user can then manually slide the back member 21 upwardly or downwardly on the arm uprights 14 to the desired elevation. When reaching the desired elevation the user releases finger pressure on the paddle members 39 so that the springs 38 urge the latching levers back toward the latching positions and simultaneously swing the paddle members outwardly to the latched position illustrated by FIG. 15. If the latching lever does not directly align with one of the slots 37, then the user can slidably displace the back member a small vertical distance until the latching levers are spring urged into the nearest adjacent slot 37.

Since the latching members automatically remain in the latched position due to cooperation with the coil springs 38, the chair hence can be readily moved about and even lifted by gripping the back member, without causing movement or separation of the back with respect to the remainder of the chair.

The back member 21 is preferably formed as a monolithic one-piece shell constructed of a plastics material and is suitably contoured so as to comfortably support the user's back, with the construction of the shell providing sufficient resiliency to enhance user comfort. It will be appreciated, however, that the back shell can also be provided with cushions and/or upholstered coverings thereover, as is conventional in chair constructions, if desired.

Reference will now be made to FIGS. 20–24 which illustrate therein mechanisms associated with the arm rest assembly so as to permit horizontal, lateral and height adjustment of the arm rest.

Figure 20:
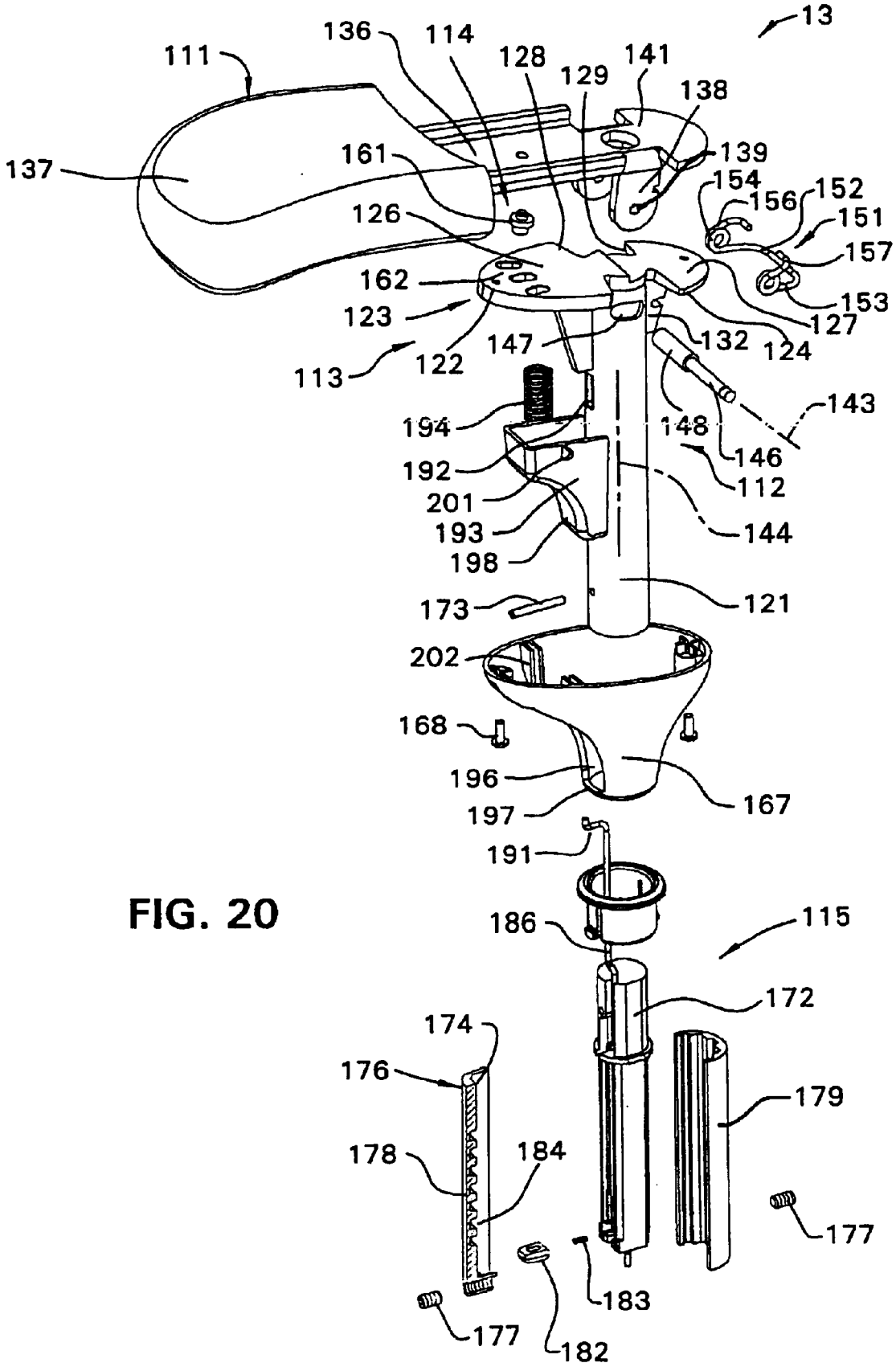
FIG. 20 is an exploded perspective view of the arm rest assembly according to the present invention.
Figure 21:
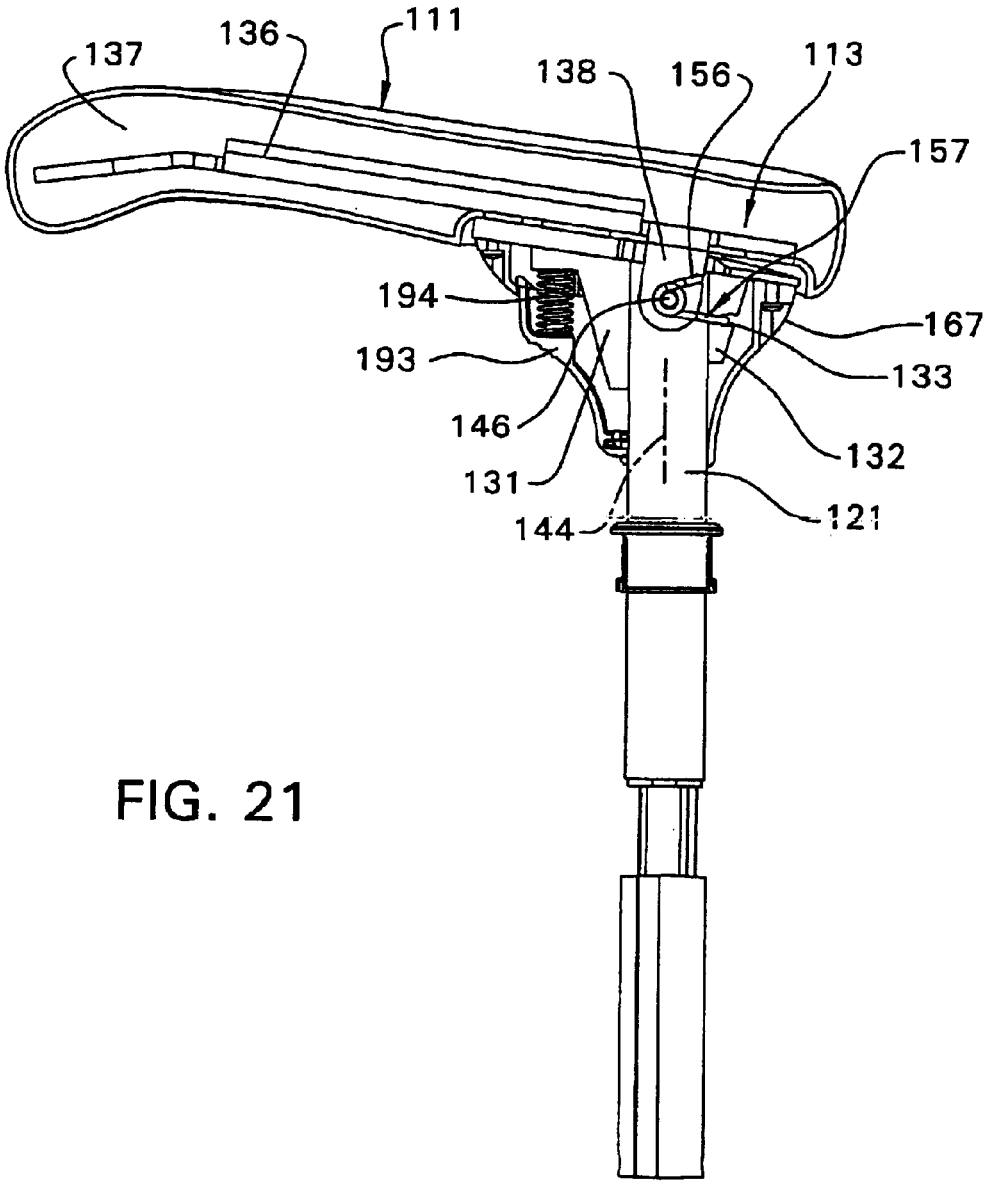
FIG. 21 is a side elevational view, partially in cross section, of the arm rest assembly shown in FIG. 20.

Referring initially to FIGS. 20–21, the arm rest assembly 13 includes a generally horizontally elongated arm rest 111 which is mounted on the upper end of an upright post assembly 112, the latter being vertically slidably telescopically engaged within the respective upright 14. A swivel connection 113 connects the upper end of post assembly 112 to arm rest 111 for permitting selected movement of the arm rest as explained hereinafter, and a disengageable lock arrangement 114 cooperates between the arm rest 111 and post assembly 112 for restricting movement of the arm rest 111.

The arm rest assembly 13 also has a height-adjusting arrangement 115 associated therewith, the latter cooperating between the arm post assembly 112 and the upright 14 for permitting selective height adjustment of the arm rest 111 as explained hereinafter.

The arm post assembly 112 includes a generally elongate upright post 121, typically a hollow cylindrical tube, having a support plate 122 fixed to the upper end thereof. The support plate 122 is transversely, i.e. horizontally, enlarged relative to the upright post 121 and includes respective front and rear plate parts 123 and 124 which project transversely from the upright post generally in the elongated direction of the arm rest 111. The plate parts 123–124 define thereon respective upper surfaces 126–127, with the rear surface 127 in the illustrated construction being parallel with but offset downwardly a small vertical extent relative to the front upper surface 126. The support plate 122 has elongate slots 128 which open inwardly adjacent opposite side edges thereof, which slots 128 are positioned so as to be disposed generally on diametrically opposite sides of the upright post 121. The slots 128 terminate at end walls 129.

The post 121 and support plate 122 are rigidly secured by riblike front and rear flanges 131 and 132, respectively, the latter being secured to the respective front and rear sides of the post 121 and projecting generally outwardly and upwardly therealong for securement to the underside of the support plate 122. The rear flange 132 has, intermediate the height thereof, an inwardly opening notch or slot 133 formed in the rear free edge thereof.

The arm rest 111 includes a generally horizontally elongated insert plate 136 which has a suitable arm pad 137 secured thereto so as to effectively enclose the insert plate. The arm pad 137 is typically of a molded material having at least limited compressibility, which material may be encased within a suitable sheetlike covering, such as is conventional, so that the pad 137 defines the exposed surfaces of the armrest for contact with the user's arms or hands.

The swivel connection 113 for connecting the arm rest 111 to the post assembly 112 includes a pair of generally parallel flanges 138 which are fixedly joined to and depend downwardly from opposite sides of the insert plate 136 so as to project downwardly through the side slots 128 formed in the support plate 122, whereby these flanges 138 effectively sidewardly straddle the upper end of the post 121. The flanges 138 have horizontally aligned openings 139 extending therethrough, which openings also align with adjacent horizontally elongated slots 147 formed in the diametrically opposite sides of the upright post 121. A generally horizontally elongate hinge pin 146 extends diametrically across the upright post 121 and outwardly through the slots 147 so that opposite ends of the hinge pin 146 are seated within the flange openings 139. The hinge pin 146, in the preferred embodiment, is rotatably supported within an elongate sleevelike bushing 148, the latter having a length such that end portions of the bushing are generally vertically confined within the elongate slots 147, which slots enable the bushing 148 and the hinge pin 146 carried thereby to be angularly displaced generally about a vertical hinge axis 144, as defined by the central axis of the post 121, through a limited horizontal angular extent, thereby permitting the arm rest 111 to be horizontally angularly moved through this limited angular extent.

The hinge pin 146 defines a horizontally elongate hinge axis 143 which extends generally transverse to the upright post 121, thereby permitting vertical angular movement of the arm rest 111 about this axis 143.

The swivel connection 113, as described above, thus defines the horizontal hinge axis 143 and the vertical hinge axis 144, which hinge axes generally transversely intersect substantially along the upright center line of the post 121 so as to permit the arm rest 111 to have a universal-type swiveling movement, namely a limited horizontal angular displacement and a limited vertical angular displacement, as explained in greater detail hereinafter.

The arm rest 111 is normally maintained in a lowered use position (i.e., a position wherein the arm rest projects dominantly horizontally) by being stationarily seated on the front support plate part 123. That is, the undersurface of the insert plate 136 normally seats against the upper surface 126 of the front support plate part 123. In this normal use position, the rear plate part 141 of the arm insert plate 136 is spaced upwardly a small distance from the opposed upper surface 127 of the rear support plate part 124. Upward tilting of the arm rest 111 away from its use position about the hinge axis 143, however, causes the rear plate part 141 to swing downwardly into contact with the rear support plate part 124 so as to limit upward angular displacement of the arm rest 111 to a small angle.

To normally maintain the arm rest 111 in its lowered use position, a spring 151 cooperates between the arm rest 111 and the post assembly 112 so as to bias the arm rest downwardly into its stationary use position. The spring 151 in the illustrated embodiment is formed in one piece from suitable spring steel and has a generally U-shaped configuration including a center bight 152 which is engaged within the flange notch 133 so that the bight extends generally transversely across the rear side of the upright post 121. The bight 152 at opposite ends joins to transverse legs 153 which at their other ends are defined by coils 154, the latter being wrapped around the protruding ends of the hinge pin 146. The coils 154 in turn have cantilevered spring legs 156 projecting outwardly and upwardly therefrom, the latter at their free ends terminating at inwardly turned tabs 157 which bear against the underside of the rear plate part 141 so as to always impose a spring force against the underside of this rear plate part 141, thereby urging the arm rest 111 in a counterclockwise direction about the hinge axis 143 to thus assist in maintaining the arm rest insert 136 seated against the upper surface 126 of the support plate 122. It will also be appreciated that other types of conventional spring constructions can be provided for cooperation between the arm rest and the upright post assembly for urging the arm rest into its seated use position.

When the arm rest 111 is in its lowered or seated use position, the lock arrangement 114 is engaged and accordingly positively prevents lateral (i.e. horizontal angular) movement of the arm rest 111 about the upright swivel axis 144. This disengageable lock arrangement 114 includes a locking projection 161 which is fixed to and is cantilevered downwardly from the arm rest insert plate 136. This locking projection 161 is adapted to be engaged within one of a series of lock-receiving openings 162, 163, 164 (three such openings shown in the illustrated embodiment) which are formed in and open downwardly from the upper surface 126 of the front support plate part 123. The openings 162–164 are disposed generally on an arcuate path generated about the vertical swivel axis 144 so that these openings hence define three discrete horizontally angularly related use positions for the arm rest 111 when the locking projection 141 is engaged within the respective openings.

Figure 22:
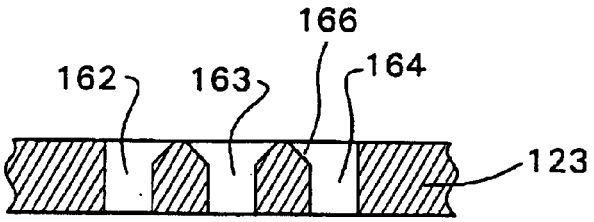
FIG. 22 is a partial cross-sectional view of a mounting plate for the arm rest assembly showing slots therein which define use positions for an arm rest

As illustrated by FIG. 22, the side walls of the adjacent openings where they merge with the upper surface 126 are preferably provided with tapered lead-in surfaces 166 so that the upper surface 126 in the region sidewardly between adjacent openings 162–163 or 163–164 is free of any significant flat surface area. The lead-in surfaces 166, coupled with the somewhat rounded lower free end of the locking projection 161, hence ensures that the locking projection when moved downwardly will self-align so as to seat within one of the openings 162–164. When fully seated in one of the openings, however, the locking projection 161 and the respective engaged opening 162–164 have opposed side surfaces which extend generally vertically so that, if a significant sideward force is imposed against the arm rest 111, the projection can not accidentally cam itself out of engagement with the opening since the lead-in surfaces 166 are associated solely with the upper end of the respective opening and hence are ineffective when the projection 161 is fully seated in the opening.

In the illustrated arrangement, the use of at least three openings is preferred such that the center opening 163, when the locking pin 161 is engaged therein, hence defines the normal center use position of the arm rest 111, in which position the arm rest 111 projects generally horizontally forwardly. However, when the locking pin 161 is engaged in the outer opening 162, then the arm rest 111 is angled slightly outwardly as it projects forwardly, and conversely when the locking pin 161 is engaged in the inner opening 164 the arm rest 111 is angled slightly inwardly relative to the seat as it projects forwardly. Since the support post 121 and the vertical hinge axis 144 is disposed in close proximity to the rearward end of the arm rest 111, the rearward end of the arm rest is not significantly positionally influenced by the selected angular position of the arm rest and hence does not significantly affect the transverse spacing between the rearward ends of the arm rests.

In operation, the arm rest 111 is maintained in its lowered use position wherein the insert plate 136 is seated against the front support plate 123, and the spring 151 exerts a biasing force against the arm rest 111 so as to assist in holding the arm rest in a stationary use position. Assuming the arm rest to be in its central position wherein the locking pin 161 is engaged in the opening 163, then any accidental sideward force applied to the arm rest will not affect movement thereof due to the positive sideward restraint provided by the locking pin 161 and the opposed side walls of the opening 163.

If the occupant wishes to adjust the lateral angularity of the arm rest 111, however, then the operator manually grips the arm rest 111 adjacent the free end thereof and exert a slight upward lifting force, thereby causing the forward end of the arm rest to tilt upwardly about the horizontal swivel axis 143 through a small angular extent sufficient to entirely withdraw pin 161 from opening 163. The upward tilting of arm rest 111 is limited by the stop plate 141 contacting the upper support plate surface 127, and in this upward tilted position the spring legs 156 have been further resiliently deflected due to their engagement with the rear plate part 141. The occupant then can manually swing the arm rest 111 horizontally either inwardly or outwardly about the vertical swivel axis 144, which horizontally swiveling of the arm rest causes the bushing 148 and its carried hinge pin 146 to move within the elongate slot 147 at least until the ends of the bushing contact the ends of the slots, in which position the locking pin 141 is disposed generally over the selected opening 162 or 164. The occupant then tilts the front end of the arm rest 111 downwardly about the hinge axis 143, which downward tilting is assisted by the biasing of the spring 151, until the locking pin 161 penetrates the respective opening 162 or 164 and the arm rest insert plate 136 seats against the surface 126 of the front support plate part 123. If the occupant does not properly align the locking pin 161 with the selected opening, then the lower rounded end of the locking pin will cammingly engage the tapered lead-in surface 166 associated with the closest opening so as to ensure that the locking pin will self-align and then move downwardly so as to properly seat within the opening.

Considering now the height-adjusting assembly 115 and referring specifically to FIGS. 20–21 and 23–24, the upright post 121 has a vertically elongate plunger housing 172 which projects vertically downwardly from the post 121 in aligned relationship therewith. The upper end of the plunger housing 172 telescopes into the post 121 and is suitably fixed thereto, such as by a transverse locking pin 173. The plunger housing 172 in turn is vertically slidably guided within a vertically elongate bore 174 defined by a vertically elongate guide sleeve 176 which is fixed interiorly within the tubular upright 14. In this respect, the guide sleeve 176 is defined by opposed sleeve halves 178 and 179 which cooperate to slidingly embrace the plunger housing 172 therebetween, and these sleeve halves 178–179 are in turn fixed to the interior of the upright 14, such as by set screw members 177. The sleeve parts 178–179 preferably have cooperating flanges and grooves which enable the two sleeve parts to be axially slidably joined so as to retain them in an assembled condition.

The plunger housing 172, adjacent the lower end thereof, has a transverse groove 181 which opens outwardly through the side wall associated with one of the sleeve halves, and a lock plunger 182 is slidably supported in this groove for movement transverse to the upright axis 14' of the upright 14. A compression spring 183 cooperates between one end of the lock plunger 182 and an inner surface on the plunger housing 172, whereby spring 183 normally urges the lock plunger 182 transversely so that the nose end 182A thereof projects outwardly for engagement with one of a series of transversely extending notches or slots 184 which are formed in vertically spaced relationship along the inner surface of the sleeve 176.

Figures 23, 24:
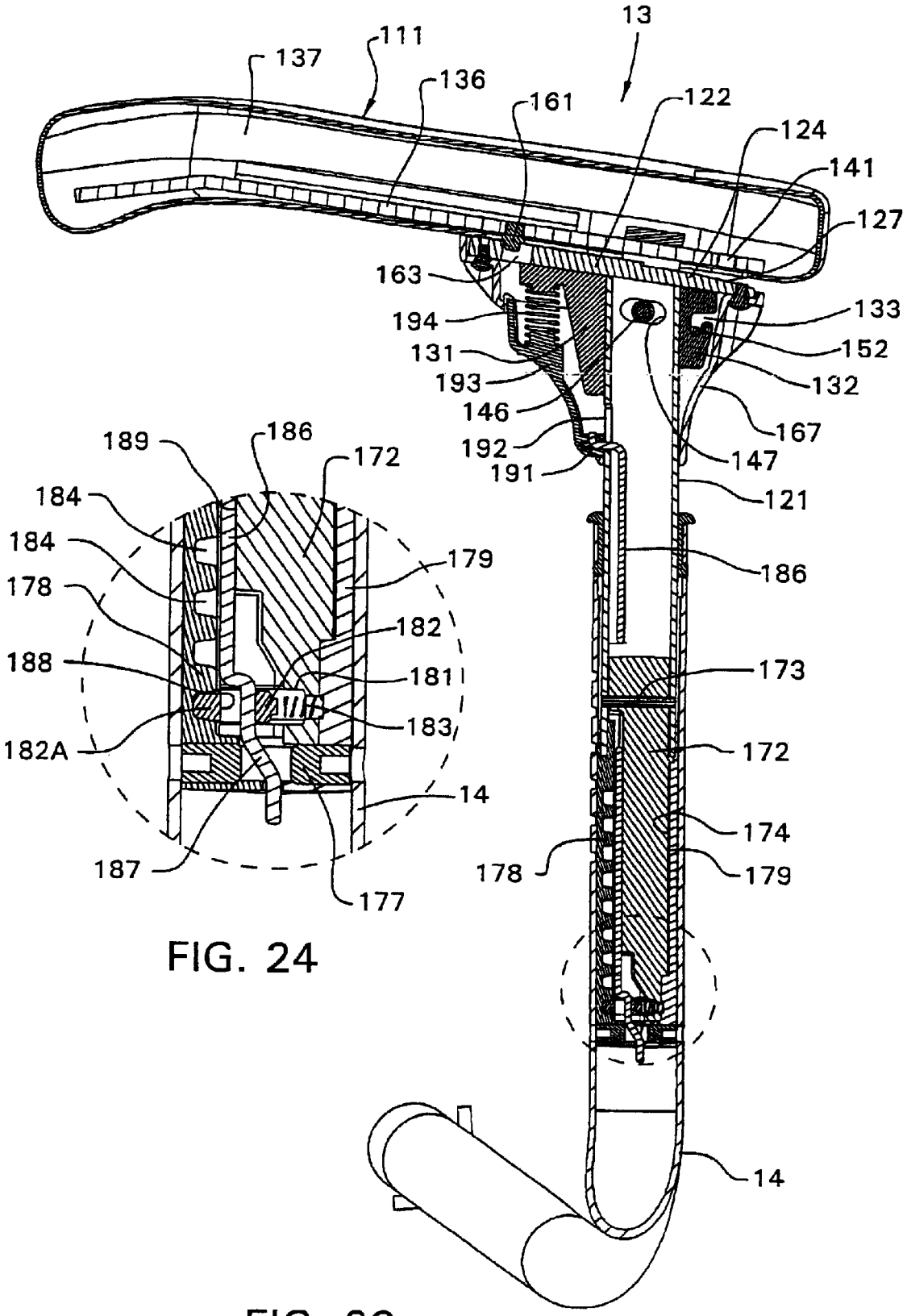
FIG. 23 is a central cross-sectional view of the height adjustment mechanism associated with the arm rest assembly.
FIG. 24 is a fragmentary enlargement illustrating the cam and latch portions associated with the height-adjusting mechanism.

The position of the lock plunger 182 is controlled by an elongate rodlike activating member 186 which extends throughout a vertically elongate groove or opening 189 formed through the plunger housing 172. The lower end of the activating member 186 has a cam part 187 formed thereon, the latter being adapted to cooperate with an opening 188 which extends vertically through the lock plunger 182. The cam part 187 is formed generally as a wedgelike or sloped surface extending at an angle relative to the transverse movement direction of the lock plunger 182 and, when the lock plunger 182 is in its engaged position as illustrated by FIG. 24, a straight rod portion of the activator 186 projects through the plunger opening 188 so that the cam part 187 is disposed directly below the plunger, whereby the spring 183 urges the plunger 182 transversely for engagement with one of the notches 184. When the activating member 186 is lifted upwardly, the cam part 187 engages an edge wall of the opening 188 so as to transversely retract the plunger 182 against the urging of the spring 183, thereby removing the plunger nose 182A from engagement with the notch 184, and allowing the arm rest assembly to be vertically slidably displaced within the guide sleeve 176.

The activating member 186 projects upwardly and has a transverse hook part 191 associated with an upper end thereof, which hook part 191 extends through a vertically elongate slot 192 formed in the side wall of the post 121, whereby the projecting hook part 191 is fixedly engaged to a vertically movable activator button or member 193. This activator button 193 is vertically slidably positioned directly adjacent an exterior side of the post 121, and is confined for vertical sliding movement within a vertically elongate slot 196 formed in a sleevelike shroud 167 which surrounds the upper end of the upright assembly. The shroud 167 is secured to the support plate 122 by screws 168. The activator button 193, when in a lowermost position, abuts the lower shroud wall 197 which acts as a motion limiting stop. The button 193 also has protrusions 201 which protrude outwardly from opposite sides thereof and which are vertically slidably guided within interior guide channels 202 formed on the inner opposed side walls of the shroud 167.

A spring 194 is positioned within the hollow interior of the activator button 193. A lower end of the spring 194 is seated on the activator button, and the upper end of the spring is seated against a shoulder defined on the post flange 131, whereby the spring 194 (a compression spring) normally maintains the activator button 193 in a lowermost position.

The activator button 193 has a rounded and concavely contoured lower surface 198 which protrudes outwardly from the shroud and is disposed so as to be readily gripped by the hand of the occupant to permit the button 193 to be manually slidably moved upwardly in opposition to the urging of the spring 194, thereby effecting upward lifting of the activating rod 186 when withdrawal of the lock plunger 182 from engagement with one of the notches 184 is desired. When the lock plunger 182 is withdrawn or unlatched, the operator can then move the arm assembly vertically upwardly or downwardly while maintaining the activator button 193 upwardly depressed. Upon reaching the desired elevation the activator button 193 is manually released and returned to its lower position by the spring 194, and the cam part 187 hence is moved downwardly to disengage the lock plunger 182 so that the spring 183 transversely moves the lock plunger into latching engagement with one of the notches 184. If the plunger 182 does not directly align with one of the notches 184, then slight vertical displacement of the arm assembly will provide the necessary alignment so that the lock plunger 182 can be spring-urged into latching engagement with an aligned notch 184.

With the chair of the present invention, the lateral adjustability of the arm rests, the height adjustability of the arm rests, and the height adjustability of the back are all individually controlled. At the same time, the adjustment mechanism for back height is positioned exteriorly in surrounding relation to the uprights 14, whereas the mechanisms for arm height adjustment are positioned interiorly of the uprights 14, whereby the back height and arm height adjustment mechanisms hence at least partially concentrically surround one another with the respective upright 14 being interposed concentrically therebetween, thereby providing a very compact and aesthetically pleasing appearance, and hence avoiding the necessity of providing additional unsightly knobs or control mechanisms which detract from the overall aesthetics of the chair, particularly the back.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair having a seat, a pair of stationary supporting parts positioned adjacent opposite sides of the seat, and an arm assembly mounted on each of said supporting parts for raised disposition adjacent one side of the seat, the arm assembly comprising:

a horizontally elongated arm rest having an upper surface disposed for contact with an occupant's arm;

a support disposed under said arm rest and supportedly engaged with the respective supporting part;

a swivel connection cooperating between said support and said arm rest permitting the arm rest to be vertically swingably moved through a small angle between lowered and raised positions, the swivel connection permitting the arm rest when in the raised position to be horizontally moved between at least two use positions spaced apart by a small horizontal angular extent; and a releasable lock cooperating between said arm rest and said support to lock the arm rest against horizontal swinging movement when the arm rest is in the lowered position and is in either of said two use positions, said lock being released when said arm rest is vertically swingably moved upwardly into said raised position.

2. A chair having a seat, a pair of stationary supporting parts positioned adjacent opposite sides of the seat, and an arm assembly mounted on each of said supporting parts for raised disposition adjacent one side of the seat, the arm assembly comprising:

a horizontally elongated arm rest having an upper surface disposed for contact with an occupant's arm;

a support disposed under said arm rest and supportedly engaged with the respective supporting part;

a swivel connection cooperating between said support and said arm rest permitting the arm rest to be vertically swingably moved through a small angle between lowered and raised positions, the swivel connection permitting the arm rest when in the raised position to be horizontally moved between at least two use positions spaced apart by a small horizontal angular extent;

said swivel connection defining first generally horizontal axis permitting the arm rest to swing upwardly from said lowered position to said raised position, and a second generally vertical axis permitting the arm rest to swing between said use positions, said first axis extending generally transverse to the elongated direction of the arm rest; and a releasable lock cooperating between said arm rest and said support to lock the arm rest against horizontal swinging movement when the arm rest is in the lowered position and is in one of said use positions.

3. The chair according to claim 2, wherein the first axis is disposed adjacent a rearward end of the arm rest.

4. The chair according to claim 2, wherein said arm rest and said support respectively include opposed upper and lower support members, and a spring cooperates between the arm rest and the support for normally urging the arm rest into said lower position so that the upper support member is in supporting engagement with said lower support member.

5. The chair according to claim 4, wherein said first and second axes extend perpendicularly in substantially intersecting relation to one another.

6. The chair according to claim 4, wherein the upper and lower support members have opposed stop parts which contact when the arm rest is in said raised position.

7. The chair according to claim 4, wherein said support includes a vertically elongate rod member which projects downwardly and is telescopically engaged with the respective supporting part, and said lower support member comprises a generally horizontally elongated platelike member fixed to an upper end of said rod member and projecting generally in the elongated direction of the arm rest.

8. The chair according to claim 7, wherein said swivel connection includes a horizontal hinge pin defining said first axis and supportingly carried on said upper support member, said swivel connection also including a horizontal elongated slot arrangement formed in said lower support member and vertically confining said hinge pin therein while permitting the hinge pin to generally horizontally swivel about said second axis.

9. The chair according to claim 8, wherein said lower support member includes an upright tube having a generally horizontally elongated plate part fixed to an upper end thereof, said plate part being elongated in the elongate direction of the arm rest, said support tube having said slot arrangement formed therein, said upper support member including a plate portion which is horizontally elongated in the elongate direction of the arm rest and generally overlies said plate part, said plate portion having a downwardly projecting tab structure which sidewardly overlies said slot arrangement, said hinge pin being vertically restrained by said slot arrangement and engaged with said tab structure.

10. The chair according to claim 9, wherein said releasable lock includes a lock pin cantilevered vertically from one of said upper and lower support members, and at least two sidewardly spaced openings formed in the other of said support members in radially spaced relation from said second axis, said lock pin being engaged within one of said openings only when the arm rest is in the lowered position.

11. The chair according to claim 10, wherein said lock includes three openings disposed in angularly spaced relation about said second axis, said openings including right and left openings disposed on opposite sides of a center opening, said openings having adjacent side walls which are sloped to assist in guiding the locking pin into said opening and to prevent the formation of flat dead zones between adjacent said openings.

12. The chair according to claim 8, wherein said hinge pin and said spring are carried on said arm rest and rotate therewith about said second axis.

13. The chair according to claim 2, wherein the supporting part includes a tubular upright which is cantilevered upwardly adjacent one side of said seat, wherein said support includes a vertically elongate tubular part which is cantilevered downwardly from said arm rest and which is telescopically slidably supported relative to said tubular upright, and a releasable height adjustable mechanism coupled between said support and said tubular upright for adjusting the elevation of the arm rest.

14. The chair according to claim 2, wherein said releasable lock includes a locking member cantilevered vertically from one of said upper and lower support members, and at least two sidewardly spaced vertically-oriented openings formed in the other of said support members in radially spaced relation from said second axis, said locking member being engaged within one of said openings only when the arm rest is in the lowered position.

15. The chair according to claim 14, wherein said lock includes three said openings disposed in angularly spaced relation about said second axis, said openings including right and left openings disposed on opposite sides of a center opening, said openings having adjacent side walls which are sloped to assist in guiding the locking member into said opening during downward swinging of the arm rest into said lowered position, said sloped side walls preventing the formation of flat dead zones between adjacent said openings.

16. An adjustable chair arm assembly, comprising:

a horizontally elongated arm rest having an upper surface for contact with a chair occupant's arm;

a vertically elongated support projecting downwardly from said arm rest adjacent a rear end thereof;

a swivel connection joining said arm rest to said support for permitting swinging movement of the arm rest both horizontally and vertically through small angular extents; and a lock mechanism coacting between said arm rest and said support to prevent horizontal swinging of said arm rest when it is in a lowered horizontal position and being released when the arm rest is vertically swung upwardly away from the lowered horizontal position into a raised release position which permits horizontal swinging of said arm rest.

17. The chair according to claim 16, wherein the swivel connection includes a hinge pin carried by said arm rest defining a first substantially horizontal hinge axis extending transverse to the lengthwise extent of the arm rest, said hinge pin being movably supported on said support for limited angular movement about a second hinge axis which extends substantially vertically.

18. The chair according to claim 16, wherein the lock mechanism comprises a plurality of sidewardly spaced vertical openings formed in one of said arm rest and support, and a vertically cantilevered lock member projecting from the other of said arm rest and support for engaging one of said openings when the arm rest is in said a lowered position.

19. The chair according to claim 18, wherein said support comprises a post vertically slidably movable downwardly into an upright support tube positioned adjacent one side of a chair seat, and a releasable latch mechanism cooperating therebetween for permitting the height of the arm rest to be selectively varied.

20. The chair according to claim 19, including a manually movable trigger positioned under said arm rest and mounted for vertical slidable movement along said support and connected to an elongate activating member extending downwardly along said post for actuating said latch mechanism.

21. A chair comprising:

a seat;

a pair of stationary uprights projecting upwardly adjacent opposites of the seat;

a back supported by said pair of uprights and projecting upwardly adjacent a rear edge of said seat, said back having a pair of support sleeves on opposite sides thereon positioned in surrounding and supportive engagement with said uprights;

an arm rest assembly mounted on each said upright, each said arm rest assembly including a vertically elongate support post which is telescoped in a said upright and projects upwardly therefrom and at its upper end is connected to a horizontally elongated arm rest having an upper surface for contact with a chair occupant's arm;

a position adjusting mechanism cooperating between the support post and arm rest for permitting the arm rest to be horizontally laterally adjusted into one of a plurality of positions, said mechanism providing a positive locking of the arm rest in the selected position;

a height adjusting mechanism cooperating between the post and the respective upright for permitting the height of the arm rest to be selectively varied; and an activating trigger carried on said arm rest assembly and interconnected to said height adjusting mechanism for permitting activation thereof.

22. The chair according to claim 21, wherein a height adjusting arm is coupled between said support sleeves and the respective uprights for permitting the height of the back to be adjusted.

23. A chair comprising:

a seat;

a pair of stationary sidewardly-spaced and generally parallel uprights projecting upwardly relative to said seat;

a back supported by said pair of uprights and projecting upwardly adjacent a rear edge of said seat, said back having a pair of support parts on opposite sides thereof and each position in supportive sliding engagement with a respective one of said uprights;

a back height adjusting mechanism cooperating between each said support part and the respective upright for permitting the height of the back to be adjusted;

an arm rest assembly mounted on each said upright, each said arm rest assembly including a horizontally elongated arm rest positioned in upwardly spaced relationship adjacent one side of said seat and having an upper surface for contact with a chair occupant's arm, said arm rest assembly also including an elongate support having one end joined to an underside of said arm rest and having an opposite end slidably and supportingly engaged with the respective said upright;

an arm rest adjusting mechanism cooperating between the support and the arm rest for permitting the arm rest to be horizontally laterally adjusted into one of a plurality of positions;

an arm height adjusting mechanism cooperating between said support and said respective upright for permitting the height of the respective arm rest to be selectively varied; and an activating trigger carried on said arm rest assembly and interconnected to said height adjusting mechanism for permitting activation thereof.

24. A chair according to claim 23, wherein a releasable lock cooperates between the arm rest and the support for permitting the arm rest to be horizontally angularly displaced into a selected one of a plurality of different use positions, said lock being released only by upward angular swinging of the arm rest into a raised position, in which raised position the arm rest can be angularly swingably moved horizontally so as to be subsequently lowered and locked in a different use position.

* * * * *

UNITED STATES PATENT AND TRADEMARK OFFICE

CERTIFICATE OF CORRECTION

PATENT NO. : 6,811,224 B2
DATED : November 2, 2004
INVENTOR(S) : Lynn Roney et al.

It is certified that error appears in the above-identified patent and that said Letters Patent is hereby corrected as shown below:

Column 13,
Line 59, after "defining" insert -- a --.
Line 47, change "said a lowered" to -- said lowered --.

Signed and Sealed this

Fifteenth Day of March, 2005

JON W. DUDAS
*Director of the United States Patent and Trademark Office*